US008624814B2

(12) United States Patent
Kim

(10) Patent No.: US 8,624,814 B2
(45) Date of Patent: Jan. 7, 2014

(54) LIQUID CRYSTAL DISPLAY AND INVERSION DRIVING METHOD THEREOF

(75) Inventor: Cheol-Min Kim, Sungnam-si (KR)

(73) Assignee: Samsung Display Co., Ltd. (KR)

( * ) Notice: Subject to any disclaimer, the term of this patent is extended or adjusted under 35 U.S.C. 154(b) by 533 days.

(21) Appl. No.: 12/578,731

(22) Filed: Oct. 14, 2009

(65) Prior Publication Data

US 2010/0123702 A1 May 20, 2010

(30) Foreign Application Priority Data

Nov. 17, 2008 (KR) ..... 10-2008-0114092

(51) Int. Cl.
*G09G 3/36* (2006.01)
*G09G 5/00* (2006.01)

(52) U.S. Cl.
USPC ..... 345/96; 345/209

(58) Field of Classification Search
USPC ..... 345/96, 209, 87
See application file for complete search history.

(56) References Cited

U.S. PATENT DOCUMENTS

2002/0084969 A1* 7/2002 Ozawa ..... 345/96
2003/0001813 A1* 1/2003 Sekiguchi ..... 345/96
2003/0011583 A1* 1/2003 Yamazaki ..... 345/204
2003/0020677 A1* 1/2003 Nakano ..... 345/87

* cited by examiner

*Primary Examiner* — Chanh Nguyen
*Assistant Examiner* — John Kirkpatrick
(74) *Attorney, Agent, or Firm* — Cantor Colburn LLP

(57) ABSTRACT

A liquid crystal display ("LCD") includes a liquid crystal panel having gate lines, data lines and pixels. The pixels are grouped into pixel lines. The LCD further includes a data driver which performs line-inversion driving by applying a data voltage having a positive or a negative polarity to the pixels such that the pixels in each pixel line have a same polarity. The pixel lines are grouped into first and second pixel line groups. A polarity of the pixels in each pixel line of the first pixel line group is the same as a polarity of the pixels in at least one pixel line disposed on an immediately adjacent side thereof. A polarity of the pixels in each pixel line of the second pixel line group is opposite to a polarity of both pixels in pixel lines disposed on two immediately adjacent sides thereof.

17 Claims, 13 Drawing Sheets

FIG. 3

| | | SFa | | SFb | | SFc | | SFd | | SFe | | SFf | | | | | |
|---|---|---|---|---|---|---|---|---|---|---|---|---|---|---|---|---|---|
| | Frame / Pixel Line | 1 | 2 | 3 | 4 | 5 | 6 | 7 | 8 | 9 | 10 | 11 | 12 | 1 | 2 | 3 | ••• |
| LB | 1 | + | − | + | − | + | + | − | − | + | − | + | − | + | − | + | − |
| LB | 2 | + | + | − | − | + | − | + | − | + | − | + | − | + | + | − | − |
| LB | 3 | − | + | − | + | − | + | − | + | − | − | + | + | − | + | − | + |
| LB | 4 | + | − | + | − | + | − | + | − | + | + | − | − | + | − | + | − |
| LB | 5 | − | − | + | + | − | + | − | + | − | + | − | + | − | − | + | + |
| LB | 6 | − | + | − | + | − | − | + | + | − | + | − | + | − | + | − | + |
| | 1 | + | − | + | − | + | + | − | − | + | − | + | − | + | − | + | − |
| | 2 | + | + | − | − | + | − | + | − | + | − | + | − | + | + | − | − |
| | ⋮ | − | + | − | + | − | + | − | + | − | − | + | + | − | + | − | + |

FIG. 8

| | SFa | | SFb | | SFc | | SFd | | SFe | | SFf | | | | |
|---|---|---|---|---|---|---|---|---|---|---|---|---|---|---|---|
| Frame / Pixel Line | 1 | 2 | 3 | 4 | 5 | 6 | 7 | 8 | 9 | 10 | 11 | 12 | 1 | 2 | 3 | ... |
| 1 | + | − | + | − | + | − | + | − | + | − | + | − | + | − | + | − |
| 2 | + | + | − | − | + | + | − | − | + | − | + | − | + | + | − | + |
| 3 | − | + | + | + | − | − | + | + | − | − | − | + | − | + | + | − |
| 4 | − | − | + | + | + | + | − | + | − | + | + | − | + | − | + | + |
| 5 | + | − | + | + | + | + | − | + | − | + | + | + | − | + | + | + |
| 6 | + | + | + | + | + | + | + | + | + | + | + | + | + | + | + | + |
| 1 | + | + | + | + | + | + | + | + | + | + | + | + | + | + | + | + |
| 2 | + | + | + | + | + | + | + | + | + | + | + | + | + | + | + | + |
| ... | − | − | − | − | − | − | − | − | − | − | − | − | − | − | − | − |

LB

LIQUID CRYSTAL DISPLAY AND INVERSION DRIVING METHOD THEREOF

This application claims priority to Korean Patent Application No. 10-2008-0114092, filed on Nov. 17, 2008, and all the benefits accruing therefrom under 35 U.S.C. §119, the contents of which in its entirety are herein incorporated by reference.

BACKGROUND OF THE INVENTION

1. Field of the Invention

The present invention relates to a liquid crystal display ("LCD") and a method of driving the same. More particularly, the present invention relates to an LCD having substantially reduced power consumption and improved display quality, and a method of driving the LCD.

2. Description of the Related Art

In general, a liquid crystal display ("LCD") includes a first display substrate having pixel electrodes, a second display substrate having a common electrode and a dielectrically anisotropic liquid crystal layer interposed between the first display substrate and the second display substrate. The pixel electrodes are arranged in a substantially matrix pattern on the first display substrate and are connected to switching devices such as thin-film transistors ("TFTs"), for example. A data voltage is sequentially applied to rows of the pixel electrodes on the first display substrate. The common electrode is disposed on a surface of the second display substrate and receives a common voltage. The liquid crystal layer interposed between the pixel electrodes on the first display substrate and the common electrode on the on the second display substrate forms a liquid crystal capacitor, and the liquid crystal capacitor and a corresponding switching device connected to the liquid crystal capacitor form a basic unit of a pixel.

The LCD generates an electric field in the liquid crystal layer by applying voltages to the pixel electrodes and the common electrode. An intensity of the electric field is adjusted to control an amount of light transmitted through the liquid crystal layer. Thus, the LCD displays a desired image.

When an electric field aligned in a given direction is applied to the liquid crystal layer for a long time, a display quality of the LCD substantially deteriorates. To help prevent this problem, a polarity of the data voltage, with respect to a polarity of the common voltage, is inverted based on units of frames, rows or pixels.

BRIEF SUMMARY OF THE INVENTION

Exemplary embodiments of the present invention provide a liquid crystal display ("LCD") which has substantially reduced power consumption and substantially improved display quality.

Alternative exemplary embodiments of the present invention provide a method of driving an LCD which has substantially reduced power consumption and substantially improved display quality.

According to an exemplary embodiment of the present invention, an LCD includes a liquid crystal panel having gate lines, data lines crossing the gate lines and pixels connected to the gate lines and the data lines. The pixels are grouped into pixel lines. The LCD further includes a data driver which performs line-inversion driving by applying a data voltage having one of a positive polarity and a negative polarity to the pixels, such that the pixels in each pixel line have a same polarity. The pixel lines are divided into a first pixel line group and a second pixel line group. A polarity of the pixels in each pixel line of the first pixel line group is the same as a polarity of the pixels in one of both pixel lines disposed on two immediately adjacent sides thereof, and a polarity of the pixels in each pixel line of the second pixel line group is opposite to a polarity of the pixels in both pixel lines disposed on two immediately adjacent sides thereof.

According to an alternative exemplary embodiment of the present invention, a method of driving an LCD includes providing a liquid crystal panel which includes gate lines, data lines crossing the gate lines and pixels connected to the gate lines and the data lines. The pixels are grouped into pixel lines. The method further includes performing line-inversion driving by applying a data voltage having one of a positive polarity and a negative polarity to the pixels such that pixels in each pixel line have a same polarity. The pixel lines are divided into a first pixel line group and a second pixel line group. A polarity of the pixels in each pixel line of the first pixel line group is the same as a polarity of the pixels in one of both pixel lines disposed on two immediately adjacent sides thereof, and a polarity of the pixels in each pixel line of the second pixel line group is opposite to a polarity of the pixels in both pixel lines disposed on two immediately adjacent sides thereof.

BRIEF DESCRIPTION OF THE DRAWINGS

The above and other aspects, features and advantages of the present invention will become more readily apparent by describing in further detail exemplary embodiments thereof with reference to the accompanying drawings, in which:

FIG. 3 is a table of pixel lines and frames for explaining an exemplary embodiment of an inversion-driving method used by a data driver of the LCD shown in FIG. 1;

FIG. 8 is a table of pixel lines and frames for explaining an exemplary embodiment of an inversion-driving method used by a data driver of the LCD shown in FIG. 4;

DETAILED DESCRIPTION OF THE INVENTION

Figure 1:
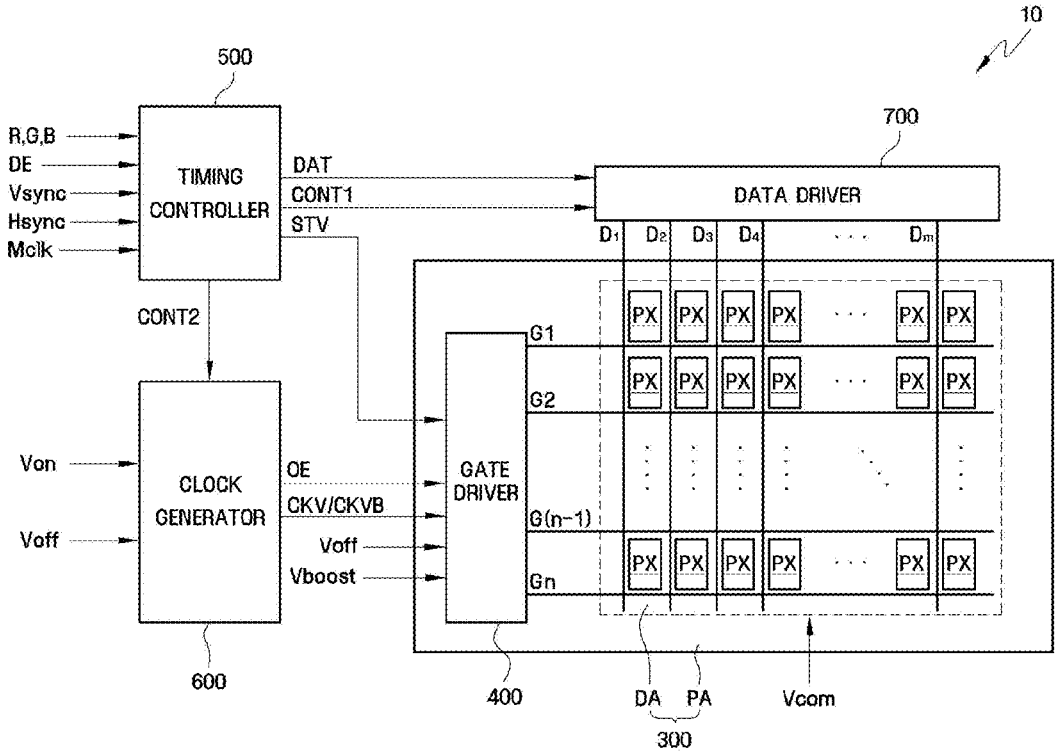
FIG. 1 is a block diagram of an exemplary embodiment of a liquid crystal display ("LCD") according to the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, a liquid crystal display ("LCD") and a method of driving the same according to exemplary embodiments will be described in further detail with reference to the accompanying drawings.

Figure 2:
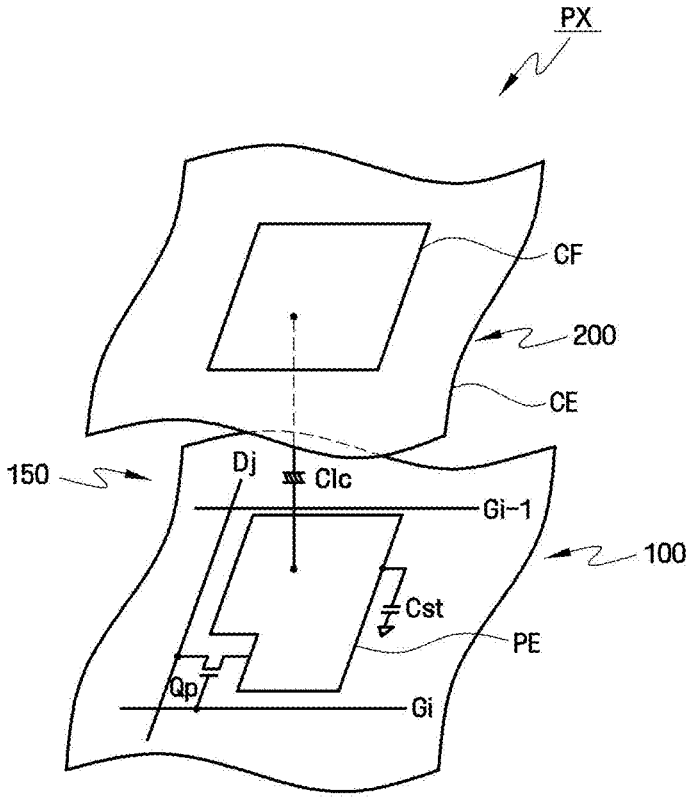
FIG. 2 is an equivalent circuit diagram of a pixel included in the LCD shown in FIG. 1.

More particularly, an LCD 10 and a method of driving the same according to an exemplary embodiment will now be described in further detail with reference to FIGS. 1 through 3. FIG. 1 is a block diagram of an exemplary embodiment of the LCD 10 and the method of driving the same according to the present invention. FIG. 2 is an equivalent circuit diagram of a pixel PX included in the LCD 10 shown in FIG. 1. FIG. 3 is a table of pixel lines and frames for explaining an exemplary embodiment of an inversion-driving method used by a data driver 700 of the LCD 10 shown in FIG. 1.

Referring to FIG. 1, the LCD 10 according to an exemplary embodiment includes a liquid crystal panel 300, a timing controller 500, a clock generator 600, a gate driver 400 and the data driver 700. The timing controller 500 and the clock generator 600 form a signal provider.

The liquid crystal panel 300 is divided into a display region DA, on which images are displayed, and a non-display region PA, where images are not displayed.

Referring to FIGS. 1 and 2, the display region DA, in which images are displayed, includes a first substrate 100 on which a plurality of gate lines G1 through Gn, a plurality of data lines D1 through Dm a plurality of pixel-switching devices Qp and a plurality of pixel electrodes PE are disposed, a second substrate 200 on which a color filter CF and a common electrode CE are disposed, and a liquid crystal layer 150 which is interposed between the first substrate 100 and the second substrate 200. Gate lines G1 through Gn of the plurality of gate lines G1 through Gn extend in a first direction, e.g., a substantially row direction, substantially parallel to each other, while data lines D1 through Dm of the plurality of data lines D1 through Dm extend in a second direction, e.g., a substantially column direction substantially perpendicular to the first direction, substantially parallel to each other.

Referring to FIG. 2, the pixels PX are connected to gate lines and data line, for example, an $i^{th}$ (where i=1 to n) gate line Gi and a $j^{th}$ (where j=1 to m) data line Dj. In addition, each of the pixels PX includes the pixel-switching device Qp, which is connected to the $i^{th}$ gate line Gi and the $j^{th}$ data line Dj, and the liquid crystal capacitor Clc and the storage capacitor Cst which are both connected to the pixel-switching device QP.

More specifically, the liquid crystal capacitor Clc according to an exemplary embodiment includes the pixel electrode PE, which is disposed on the first substrate 100, and the common electrode CE which is disposed on the second substrate 200 opposite to, e.g., substantially facing, the pixel electrode PE. The pixel electrode PE is connected to the $i^{th}$ gate line Gi by the pixel-switching device Qp. The color filter CF may be formed in a region proximate to the common electrode CE on the second substrate 200. In an exemplary embodiment, the pixel-switching device Qp may be a thin-film transistor ("TFT") made of amorphous silicon ("a-Si") (hereinafter, referred to as an "a-Si TFT").

Referring again to FIG. 1, the pixels PX are connected to the gate lines G1 through Gn and the data lines D1 through Dm. As shown in FIG. 1, when the gate lines G1 through Gn are arranged substantially parallel to each other in the row direction of the liquid crystal panel 300 and when the data lines D1 through Dm are arranged substantially parallel to each other in the column direction of the liquid crystal panel 300, the pixels PX are arranged in the row and the column directions of the liquid crystal panel 300 in a substantially matrix pattern. For purposes of description herein, an exemplary embodiment in which the pixels PX are arranged in the matrix pattern will be described. However, the arrangement of the pixels PX is not limited to the matrix pattern in alternative exemplary embodiments.

In an exemplary embodiment the pixels PX are grouped into a plurality of pixel lines which are connected to the gate lines G1 through Gn. For example, when the pixels PX are arranged in the matrix, pixels PX connected to the first gate line G1 form a pixel line. Similarly, pixels PX coupled to each of the second through $n^{th}$ gate lines G2 through Gn form respective pixel lines for each of the second through $n^{th}$ gate lines G2 through Gn. In addition, the pixel lines are divided into first pixel line groups and second pixel line groups, and pixel line in the first pixel line group has a polarity identical, e.g., substantially the same as, at least one polarity of a data voltage applied to immediately previous adjacent pixel lines and/or immediately next adjacent pixel lines. In the second pixel line groups, each pixel line has a polarity opposite to polarities of data voltages applied to both immediately previous adjacent and immediately next adjacent pixel lines. The pixel lines and their polarities, based on the first pixel line group and the second pixel line group, will be described in further detail below with reference to FIG. 3.

The non-display region PA is an area where images are not displayed, since the area is where the first substrate 100 (FIG. 2) is wider than, e.g., overlaps, the second substrate 200 (FIG. 2).

Still referring to FIG. 1, in an exemplary embodiment, the timing controller 500 receives, from an external graphic controller (not shown), input image signals R, G and B and input control signals for controlling display of the input image signals R, G and B and provides image signals DAT and data control signals CONT1 to the data driver 700. More specifically, the timing controller 500 receives input control signals, such as a vertical synchronization signal Vsync, a horizontal synchronization signal Hsync, a main clock signal Mclk and a data enable signal DE, for example, and outputs the data control signals CONT1. The data control signals CONT1 control an operation of the data driver 700 and include, for example, a horizontal start signal (not shown) for starting an operation of the data driver 700 and a load signal (not shown) for instructing the output of data voltages.

The data driver 700 receives the image signals DAT and the data control signals CONT1 and provides the data voltages, which correspond to the image signals DAT, to the data lines D1 through Dm. The data voltages may be generated based on a plurality of grayscale voltages which are provided by, e.g., a grayscale voltage generator (not shown). In addition, the data voltage provided to each of the data lines D1 through Dm may be applied to each pixel PX via the pixel-switching device Qp (FIG. 2) which is turned on in response to a corresponding gate signal of gate signals Gout 1 through Gout(n).

The data driver 700 inverts a polarity of the data voltage applied to each pixel PX to prevent deterioration of display quality which occurs when an electric field in a given direction is continually applied to the liquid crystal layer. Thus, the data voltages include data voltages having a positive polarity and data voltages having a negative polarity. In the LCD 10 according to an exemplary embodiment and the method of driving the same, the data voltages having the positive polarity or the negative polarity are applied to the pixels PX such that the pixels PX included in each pixel line have a same polarity. In addition, the data voltages having the positive polarity and the data voltages having the negative polarity are applied at an equal ratio to the pixels PX in a given frame, as will be described in further detail below. The data driver 700 repeatedly applies sets of data voltages (hereinafter, referred to as a "data voltage set") with a predetermined polarity pattern to groups of the pixel lines. A minimum number of groups of pixel lines to which the data voltage set with the predetermined polarity pattern is applied is defined as a line block LB (FIG. 3).

Thus, the pixels PX of the liquid crystal panel 300 are grouped into pixel lines which correspond to the gate lines G1 through Gn, and the pixel lines are further grouped into line blocks LB, each having a minimum number of pixel lines to which a given data voltage set having predetermined polarity pattern is applied. Moreover, each of the line blocks LB includes both the first pixel line group and the second pixel line group, as described above. An inversion-driving method used by the data driver 700 will be descried in further detail below with reference to FIG. 3.

The data driver 700 may be implemented as an integrated circuit ("IC"), and is connected to the liquid crystal panel 300 in the form of a tape carrier package ("TCP"). However, alternative exemplary embodiments are not limited thereto. In addition, the data driver 700 may be disposed on the non-display region PA of the liquid crystal panel 300.

In an exemplary embodiment, the timing controller 500 provides clock-generation control signals CONT2 to the clock generator 600 and a scan start signal STV to the gate driver 400. The clock generation control signals CONT2 may include a gate clock signal (not shown), which determines when to output a gate-on voltage Von, and an output enable signal OE, which determines a pulse width of the gate-on voltage Von.

The clock generator 600 may output a clock signal CKV and a clock bar signal CKVB, which both swing between the gate-on voltage Von and a gate-off voltage Voff, based on the clock generation control signals CONT2. The clock signal CKV may be a reverse-phase signal of the clock bar signal CKVB.

The gate driver 400 is enabled by the scan start signal STV, generates a plurality of gate signals using the clock signal CKV, the clock bar signal CKVB and the gate-off voltage Voff, and sequentially transmits the gate signals to the gate lines G1 through Gn. In an exemplary embodiment, the gate driver 400 may receive a boost voltage Vboost, as will be described in further detail below with reference to FIGS. 4 through 10D.

An inversion-driving method used by the data driver 700 will now be described in further detail with reference to FIG. 3. The inversion-driving method used to drive the LCD 10 according to an exemplary embodiment is a line-inversion driving method in which pixels PX in each pixel line have a same polarity, as described above. It will be noted that the inversion-driving method illustrated in FIG. 3 is an example driving method, and can be changed without departing from the spirit or the scope of the present invention. For example, in an alternative exemplary embodiment, a data voltage having a positive polarity in FIG. 3 can be changed to a data voltage having a negative polarity, and the data voltage having the negative polarity can be applied to each pixel PX.

A horizontal axis in FIG. 3 table represents frames in units of which an image is displayed on the liquid crystal panel 300, and a vertical axis represents pixel lines in each frame. As described in greater detail above, the pixels PX arranged on the liquid crystal panel 300 are grouped into pixel lines (along the vertical axis of FIG. 3), and the pixel lines may be further grouped into the line blocks LB and divided into the first pixel line group and the second pixel line group. In an exemplary embodiment, each of the line blocks LB includes six successive pixel lines (e.g., first through sixth pixel lines), as shown in FIG. 3. In addition, the pixels PX included in a given pixel line may have a same polarity.

The inversion-driving method according to an exemplary embodiment for given a frame will now be described using a first frame as an example. Since the inversion-driving method for the first frame is substantially the same as the inversion-driving method for each of second through twelfth frames, any repetitive detailed description thereof will hereinafter be omitted or simplified.

Hereinafter, a positive polarity is indicated by a positive, or plus, sign ("+") and a negative polarity is indicated by a negative, or minus sign ("−"). Referring to FIG. 3, polarities of the six successive pixel lines (e.g., the first through sixth pixel lines) included in each line block LB of the first frame may be (+), (+), (−), (+), (−), and (−), respectively. To this end, the data driver 700 performs an inversion-driving process (e.g., inverts the polarities of the pixels PX) between the second pixel line and the third pixel line, between the third pixel line and the fourth pixel line, between the fourth pixel line and the fifth pixel line, and between the sixth pixel line and a first pixel line of a next line block LB. In an exemplary embodiment, each line block LB includes the first pixel line group, and pixel lines in the first pixel line group each have a polarity identical to a polarity of a data voltage applied to an immediately adjacent previous pixel line and/or an immediately adjacent next pixel line. In addition, each line block LB includes the second pixel line group, and pixel lines in the second pixel line group each have a polarity opposite to polarities of data voltages applied to both the immediately adjacent previous pixel line and the immediately adjacent next pixel line. Put another way, each pixel line in the first pixel line group has a polarity which is the same as at least one of the adjacent pixel lines, whereas each pixel line in the second pixel line group has a polarity which is opposite to both adjacent pixel lines.

For example, as shown in FIG. 3, in the first frame, the first pixel line group includes the first, second, fifth and sixth pixel lines, while the second pixel line group includes the third and fourth pixel lines. Likewise, in the second frame, the first pixel line group includes the second through fifth pixel lines, and the second pixel line group includes the first and sixth pixel lines. As a result, from among the six pixel lines included in each line block LB, the number of pixel lines in the second pixel line group is two. More generally, when the number of pixel lines included in each line block LB is equal to "a" and when the number of pixel lines included the second pixel line group in each line block LB is equal to "b," a ratio a:b=3:1. Therefore, a frequency of the inversion-driving process in an exemplary embodiment is substantially reduced as compared to when polarities of the pixels PX are inverted every pixel line. As shown in FIG. 3, the inversion-driving process is performed four times for the six pixel lines of each line block LB. Specifically, inversions occur between the second pixel line and the third pixel line, between the third pixel line and the fourth pixel line, between the fourth pixel line and the fifth pixel line and between the sixth pixel line and a first pixel line of a next line block LB, as shown in frame 1 of FIG. 3, as described above. Therefore, power consumption in an LCD 10 according to an exemplary embodiment is substantially reduced as compared to when the polarities of the pixels PX are inverted every pixel line, e.g., six times per line block LB.

In a given frame, pixels having either a positive polarity or a negative polarity may display white or black images, and pixels having the other one of the positive polarity and the negative polarity may display images with intermediate gray levels. In this case, when the inversion-driving process is performed every pixel line, the polarity of a data voltage applied to each pixel line which displays a white or black image which is continuously different from that of a data voltage applied to each pixel line which displays an image with an intermediate gray level, thereby causing screen flickering.

Even when the inversion-driving method according to an exemplary embodiment is used, the polarity of a data voltage applied to each pixel line, which displays a white or black image, may also be different, in some frames, from that of a data voltage applied to each pixel line which displays an image with an intermediate gray level. However, this situation does not continue, and a data voltage having a positive polarity and a data voltage having a negative polarity is be mixed and is applied accordingly to each pixel line which displays a white or black image and each pixel line which displays an image with an intermediate gray level. As a result, the display quality of the LCD 10 according to an exemplary embodiment is substantially improved.

The inversion-driving method of the data driver 700 according to an exemplary embodiment will now be described in further detail based on relationships between a plurality of frames. In an exemplary embodiment, the polarities of two or more pixel lines included in each line block LB are not changed over two or more successive frames.

As described above, pixel lines in a given frame are grouped into line blocks LB, and a data voltage set with a predetermined polarity pattern is repeatedly applied to the line blocks LB. This is repeated over a plurality of frames.

For example, referring to FIG. 3, the polarities of the pixels PX are inverted in units of twelve successive frames. Here, the twelve frames may be divided into six set frames SFa through SFf. As shown in FIG. 3, each of the set frames SFa through SFf includes two frames. However, alternative exemplary embodiments are not limited thereto.

Referring now to the pixel lines of the first and second frames, the polarities of the second and fifth pixel lines are not changed. In addition, the polarities of the second and fifth pixel lines do not change in the third and fourth frames. That is, the polarities of two or more pixel lines included in each line block LB do not change over two or more successive frames.

In a given frame, data voltages having a positive polarity and data voltages having a negative polarity are applied at an equal ratio for each pixel line. More specifically, when the polarity of a pixel line is changed over successive frames, the number of times that a data voltage having a positive polarity is applied to the pixel line may be equal to the number of times that a data voltage having a negative polarity is applied to the pixel line, thereby substantially reducing screen flickering in an LCD 10 according to an exemplary embodiment.

In the LCD 10 and the method of driving the same according to an exemplary embodiment, the number of times that the polarities of a plurality of pixel lines are inverted is substantially reduced. Thus, power consumption is substantially reduced and/or is effectively minimized In addition, since the number of times that the polarity of a data voltage applied to each pixel, which displays a black or white image, is different from that of a data voltage applied to each pixel, which displays an image with an intermediate gray level, is substantially reduced, display quality of the LCD 10 is substantially improved.

Figure 4:
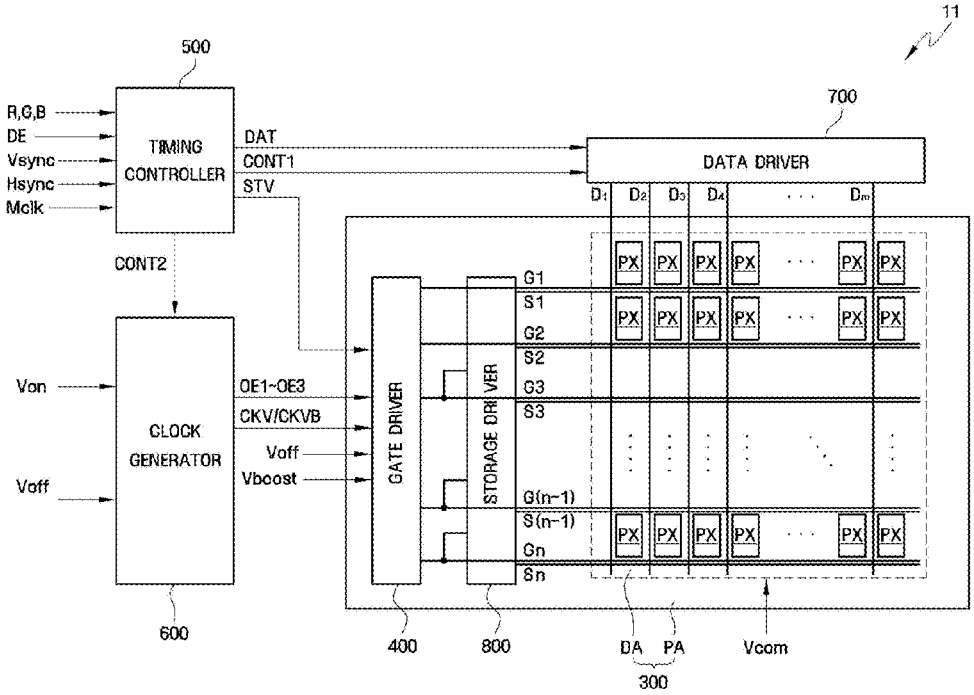
FIG. 4 is a block diagram of an alternative exemplary embodiment of an LCD according to the present invention.
Figure 5:
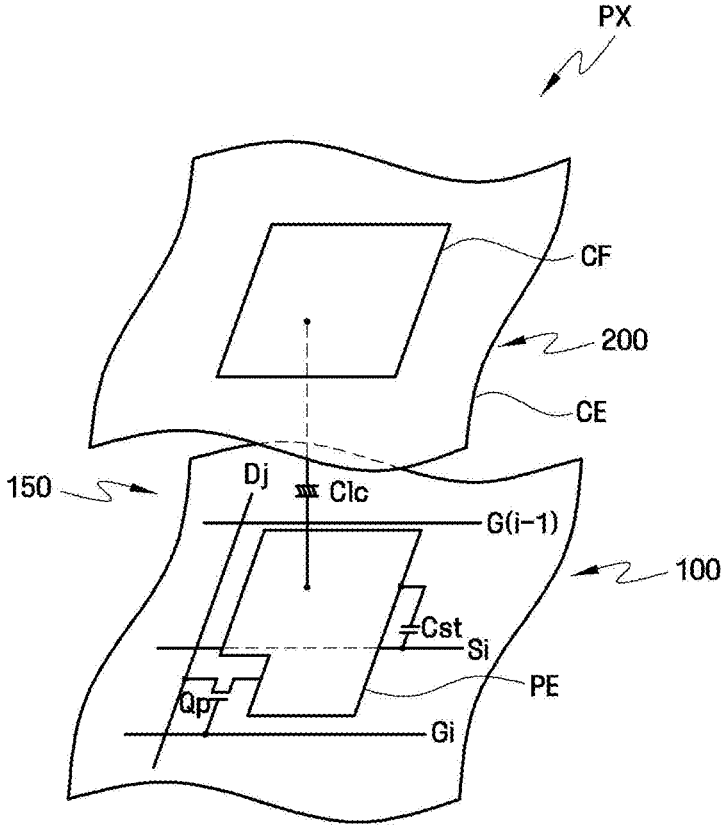
FIG. 5 is an equivalent circuit diagram of a pixel included in the LCD shown in FIG. 4.
Figure 6:
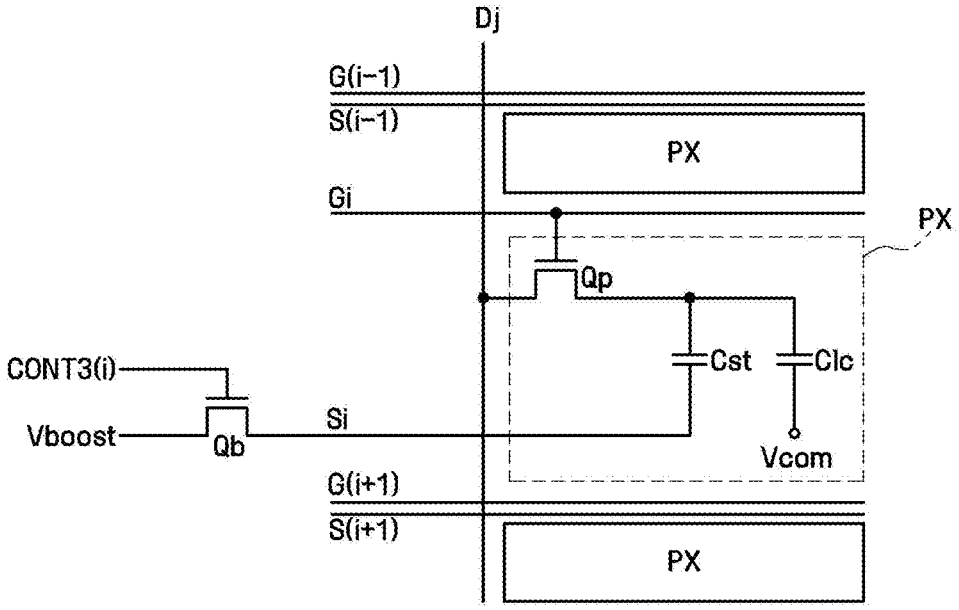
FIG. 6 is a partial schematic circuit diagram of the LCD shown in FIG. 4.
Figure 7:
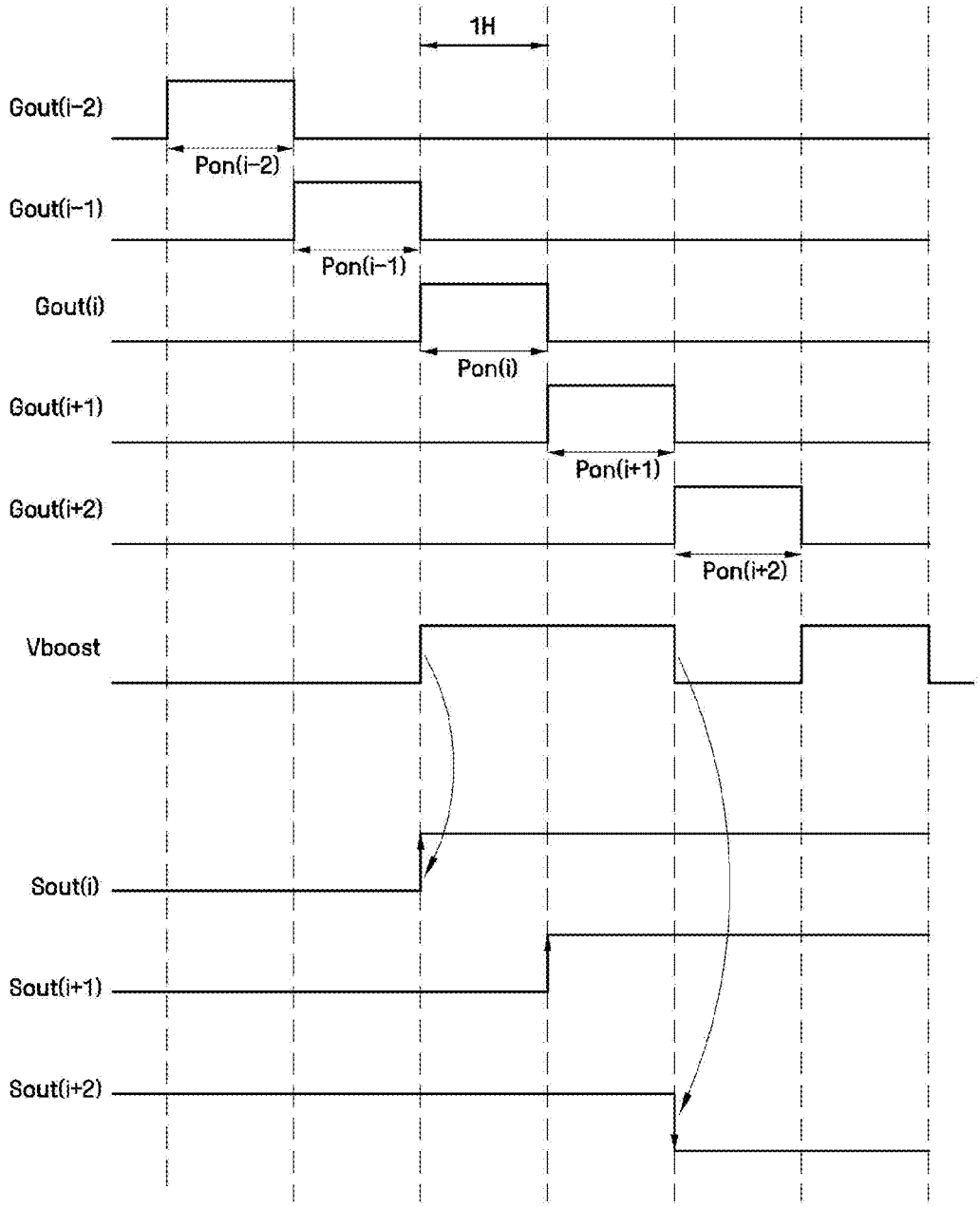
FIG. 7 is a signal timing diagram for explaining an operation of the LCD shown in FIG. 4.
Figure 9:
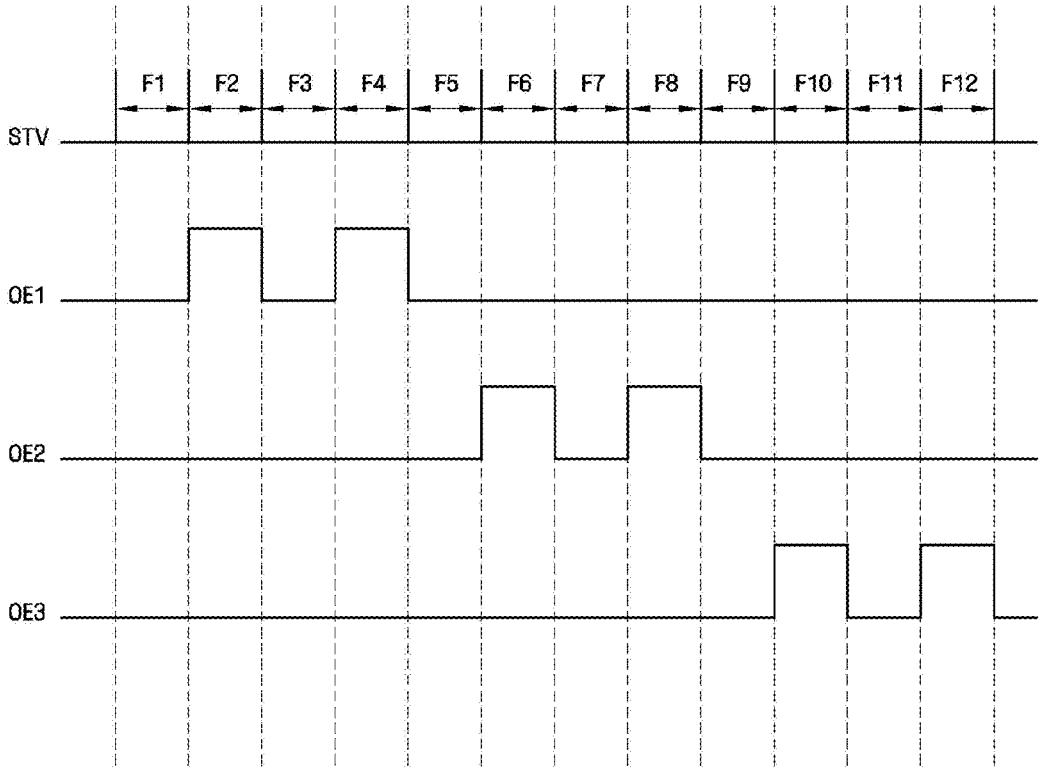
FIG. 9 is a signal timing diagram for explaining an operation of first through third output enable signals of the LCD shown in FIG. 4.

Hereinafter, an LCD 11 and a method of driving the same according to an alternative exemplary embodiment of the present invention will be described in further detail with reference to FIGS. 4 through 10D. FIG. 4 is a block diagram of an exemplary embodiment of the LCD 11 and the method of driving the same according to the present invention. FIG. 5 is an equivalent circuit diagram of a pixel PX included in the LCD 11 shown in FIG. 4. FIG. 6 is a partial schematic circuit diagram of the LCD 11 shown in FIG. 4. FIG. 7 is a signal timing diagram for explaining an operation of the LCD 11 shown FIG. 4. FIG. 8 is a table of pixel lines and frames for explaining an exemplary embodiment of an inversion-driving method used by a data driver 700 of the LCD 11 shown in FIG. 4. FIG. 9 is a signal timing diagram for explaining an operation of first through third output enable signals OE1 through OE3, respectively, of the LCD 11 shown in FIG. 4. FIGS. 10A through 10D are signal timing diagrams for explaining an operation of gate signals in corresponding frames of the first through third output enable signals OE1 through OE3, respectively, shown in FIG. 9. Elements in FIGS. 4-10D having substantially the same function as those illustrated in FIGS. 1 through 3 are labeled with the same reference characters in FIGS. 4-10D, and any repetitive detailed description thereof will hereinafter be omitted.

Referring to FIG. 4, the LCD 11 according to an alternative exemplary embodiment includes a liquid crystal panel 300, a timing controller 500, a clock generator 600, a gate driver 400, the data driver 700 and a storage driver 800. For purposes of simplicity, differences between the LCD 10 according to an exemplary embodiment and the LCD 11 according to an alternative exemplary embodiment will described, with particular emphasis on the timing controller 500, the gate driver 400, the data driver 700 and the storage driver 800, while any repetitive detailed description will be omitted or simplified.

The gate driver 400 is enabled by a scan start signal STV, generates a plurality of gate signals using a clock signal CKV, a clock bar signal CKVB and a gate-off voltage Voff, and sequentially transmits the gate signals to a plurality of gate lines G1 through Gn to control the gate lines G1 through Gn to be turned on or off.

The clock generator 600 provides a plurality of output enable signals, such as the first through third output enable signals OE1 through OE3, for example. The output enable signals control polarities of two or more pixel lines such that the polarities are unchanged in two or more successive frames, as will be described in further detail below.

The storage driver 800 according to an exemplary embodiment may apply a boost voltage Vboost to each pixel PX in response to an $i^{th}$ boost control signal CONT3(i) (FIG. 5) which corresponds to each gate signal. In an exemplary embodiment, the boost voltage Vboost may be applied to each pixel PX via a corresponding storage line of a plurality of storage lines S1 through Sn. The storage lines 51 through Sn extend substantially in parallel to each other in substantially the row direction and correspond to the gate lines G1 through Gn, respectively.

Referring now to FIG. 5, each of the pixels PX shown in FIG. 4 has substantially the same structure as the pixels PX described in greater detail above with reference to FIG. 2. However, the pixels PX in FIG. 4 are different in that a terminal of a storage capacitor Cst included in the pixel PX of FIG. 5 is connected to an $i^{th}$ storage line Si.

In FIG. 6, $(i-1)^{th}$ through $(i+1)^{th}$ gate lines G(i−1) through G(i+1), $(i-1)^{th}$ through $(i+1)^{th}$ storage lines S(i−1) through S(i+1), and the pixels PX connected to the $(i-1)^{th}$ through $(i+1)^{th}$ gate lines G(i−1) through G(i+1) and the $(i-1)^{th}$ through $(i+1)^{th}$ storage lines S(i−1) through S(i+1) are shown. As described in greater detail above, each of the pixels PX includes a liquid crystal capacitor Clc and the storage capacitor Cst. A terminal of the liquid crystal capacitor Clc is connected to a pixel-switching device Qp, and another terminal of the liquid crystal capacitor Clc is provided with a common voltage Vcom. A terminal of the storage capacitor Cst is connected to the liquid crystal capacitor Clc, and another terminal of the storage capacitor Cst is connected to the $i^{th}$ storage line Si. In an exemplary embodiment, a boost-switching device Qb applies the boost voltage Vboost to the $i^{th}$ storage line Si in response to the $i^{th}$ boost control signal CONT3(i). More specifically, the storage capacitor Cst is provided with the boost voltage Vboost depending on whether the boost-switching device Qb, which is controlled by the $i^{th}$ boost control signal CONT3(i), is turned on or off.

An operation of the LCD 11 according to an exemplary embodiment will now be described in further detail with reference to FIG. 7.

Referring to FIG. 7, an $(i-2)^{th}$ gate signal Gout(i−2) having an $(i-2)^{th}$ turn-on section Pon(i−2) is provided to an $(i-2)^{th}$ gate line G(i−2), an $(i-1)^{th}$ gate signal Gout(i−1) having an $(i-1)^{th}$ turn-on section Pon(i−1) is provided to the $(i-1)^{th}$ gate line G(i−1), and an $i^{th}$ gate signal Gout(i) having an $i^{th}$ turn-on section Pon(i) is provided to the $i^{th}$ gate line G(i). Then, an $(i+1)^{th}$ gate signal Gout(i+1) having an $(i+1)^{th}$ turn-on section Pon(i+1) is provided to the $(i+1)^{th}$ gate line G(i+1), and an $(i+2)^{th}$ gate signal Gout(i+2) having an $(i+2)^{th}$ turn-on section Pon(i+2) is provided to an $(i+2)^{th}$ gate line G(i+2). Thus, the $(i-2)^{th}$ through $(i+2)^{th}$ turn-on sections Pon(i−2) through Pon(i+2) are sequentially initiated, as shown in FIG. 7. In an exemplary embodiment, each of the $(i-2)^{th}$ through $(i+2)^{th}$ turn-on sections Pon(i−2) through Pon(i+2) may be a horizontal period 1H, and the liquid crystal capacitor Clc is charged with a data voltage in each of the $(i-2)^{th}$ through $(i+2)^{th}$ turn-on sections Pon(i−2) through Pon(i+2).

The boost voltage Vboost swings between a high level and a low level and affects a polarity of an $i^{th}$ boost output voltage Sout(i) which is applied to the $i^{th}$ storage line Si. For example, in an exemplary embodiment, when the boost voltage Vboost is at a high level, the $i^{th}$ boost output voltage Sout(i) applied to the $i^{th}$ storage line Si has a positive polarity. When the boost voltage Vboost is at a low level, however, the $i^{th}$ boost output voltage Sout(i) applied to the $i^{th}$ storage line Si has a negative polarity. As shown in FIG. 7, when the boost voltage Vboost corresponding to the $i^{th}$ gate signal Gout(i) is at a high level, the $i^{th}$ boost output voltage Sout(i) output to the $i^{th}$ storage line Si has a positive polarity. In contrast, when the boost voltage Vboost corresponding to the $(i+2)^{th}$ gate signal Gout(i+2) is at a low level, an $(i+2)^{th}$ boost output voltage Sout(i+2) output to the $(i+2)^{th}$ storage line S(i+2) has a negative polarity.

In an alternative exemplary embodiment, the $i^{th}$ boost control signal CONT3(i) may have a boost voltage output section (not shown). For example, the $i^{th}$ boost control signal CONT3(i) may remain at a high level during the boost voltage output section. During the boost voltage output section, the boost-switching device Qb (FIG. 6) may be turned on to provide the boost voltage Vboost to the $i^{th}$ storage line Si. Therefore, the boost voltage Vboost applied to the $i^{th}$ storage line Si may be referred to as the $i^{th}$ boost output voltage Sout(i).

An inversion-driving method used by the data driver 700 will now be described in further detail with reference to FIG. 8. As described in greater detail above, the inversion-driving method used to drive the LCD 11 according to an exemplary embodiment is a line-inversion driving method in which pixels in each pixel line have a same polarity, but alternative exemplary embodiments are not limited thereto.

Referring now to FIG. 8, a horizontal axis represents frames (in units of which an image is displayed on the liquid crystal panel 300) and the vertical axis represents pixel lines in each frame. As described in greater detail above, the pixels PX arranged on the liquid crystal panel 300 are grouped into a plurality of pixel lines, and the pixel lines are further grouped into a plurality of line blocks LB. In addition, a plurality of frames may be divided into a plurality of set frames, e.g., first through sixth set frames SFa through SFf, in each of which polarities of two or more pixel lines remain unchanged over two or more successive frames. Each of the line blocks LB may include six pixel lines, and the pixels PX included in each pixel line have the same polarity. In addition, the pixel lines are divided into a first pixel line group and a second pixel line group, as described in further detail above.

As also described above, polarities of two or more pixel lines in each line block LB do not change over two or more successive frames. For example, two or more pixel lines whose polarities remain unchanged in two or more successive frames may be determined by each of a plurality of output enable signals. More specifically, in response to each of the first through third out enable signals OE1 through OE3, gate signals are not outputted to two or more pixel lines in a succeeding, e.g., subsequent, frame of two or more successive frames. For example, in a second frame (e.g., the succeeding frame) of the first set frame SFa, gate signals are not outputted to gate lines which correspond to second and fifth pixel lines, and data voltages applied to the second and fifth pixel lines in a first frame (e.g., the preceding frame) of the first set frame SFa are therefore maintained throughout both frames (e.g., the entire first frame set SFa). Therefore, the data driver 700 does not need to apply data voltages to the second and fifth pixel lines in the second frame. As a result, power required to apply the data voltages is substantially reduced in the LCD 11 according to an exemplary embodiment.

Pixel lines, to which gate signals are not outputted, may also be determined by each of the output enable signals, which will now be described in further detail with reference to FIGS. 9 through 10D.

In FIG. 9, a signal timing diagram of the first through third output enable signals OE1 through OE3 is illustrated. Referring to FIG. 9, each frame is initiated by the scan start signal STV. In an exemplary embodiment, a case where a data voltage set with a predetermined polarity pattern is repeatedly applied to each pixel line in units of twelve successive frames is described. However, alternative exemplary embodiments of the present invention are not limited thereto.

Each of the first through third output enable signals OE1 through OE3 control frames in which the gate signals are not outputted to corresponding pixel lines. For example, in response to the first output enable signal OE1, gate signals are not outputted to corresponding pixel lines in second and fourth frames F2 and F4. In addition, gate signals are not outputted to corresponding pixel lines in sixth and eighth frames F6 and F8 in response to the second output enable signal OE2, and gate signals are not outputted to corresponding pixel lines in tenth and twelfth frames F10 and F12 in response to the third output enable signal OE3. As shown in FIG. 9, when the first through third output enable signals OE1 through OE3 are at a high level, gate signals are not outputted. Conversely, when the first through third output enable signals OE1 through OE3 are at a low level, the gate signals are outputted.

Referring to FIGS. 8 and 9, the first output enable signal OE1 is applied to the second and fifth pixel lines, such that gate signals are not outputted to the second and fifth pixel lines in the second and fourth frames F2 and F4. The second output enable signal OE2 is applied to the first and sixth pixel lines such that gate signals are not outputted to the first and sixth pixel lines in the sixth and eighth frames F6 and F8, and the third output enable signal OE3 is applied to the third and fourth pixel lines such that gate signals are not outputted to the third and fourth pixel lines in the tenth and twelfth frames F10 and F12. It will be noted that pixel lines, to which each of the first through third output enable signals OE1 through OE3 is applied, and frames are not limited to the exemplary embodiment shown in FIG. 9, and may be changed in various ways in alternative exemplary embodiments of the LCD 11.

Outputting gate signals based on the first through third output enable signals OE1 through OE3 will now be described in further detail with reference to FIGS. 10A through 10D.

Figure 10A:
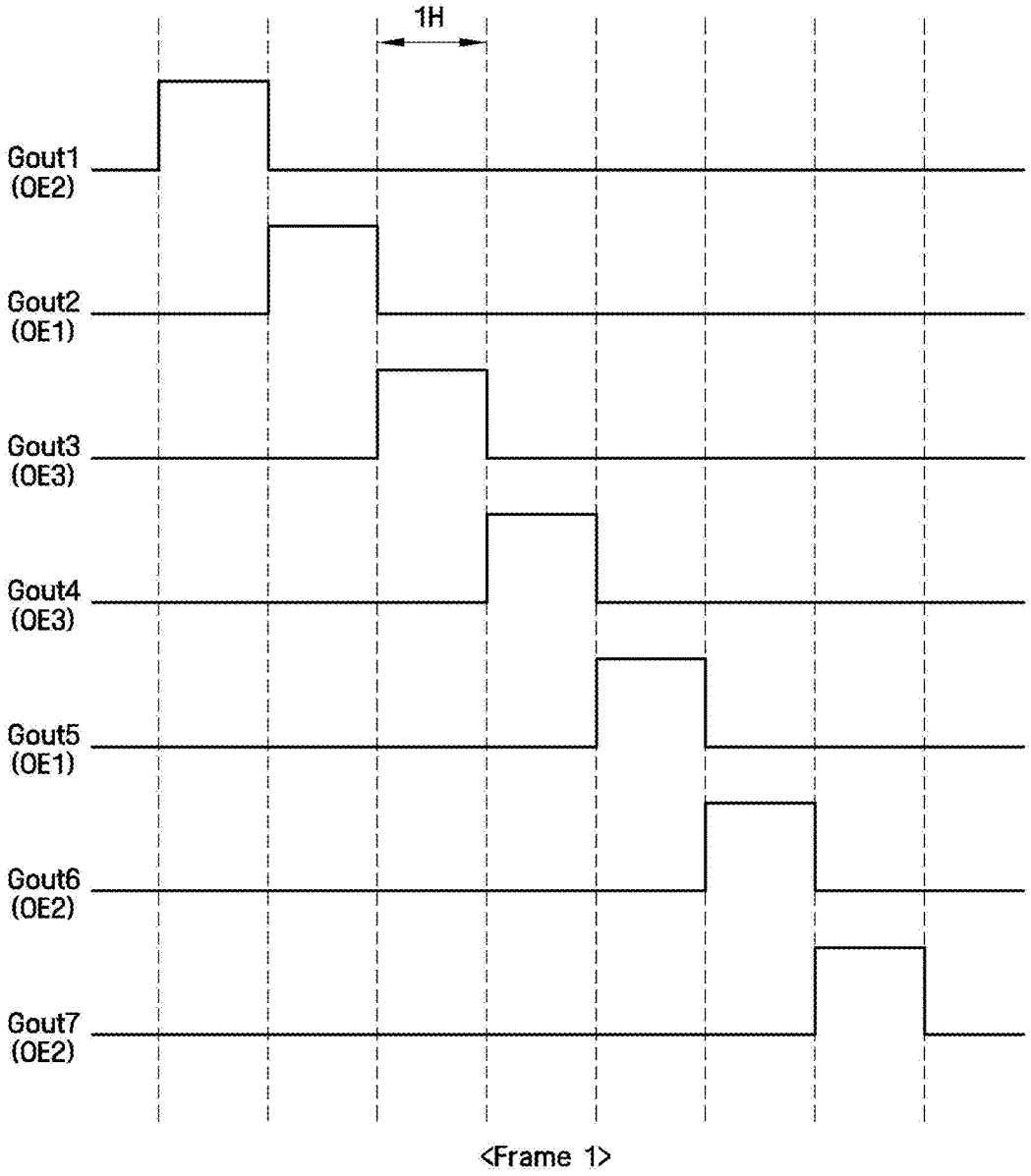
FIGS. 10A through 10D are signal timing diagrams for explaining an operation of gate signals in corresponding frames of the first through third output enable signals shown in FIG. 9.

Referring to FIG. 10A, in a first frame, gate signals Gout1 through Gout 7 are transmitted to all pixel lines included in each line block LB. In FIG. 10A, a horizontal direction represents time, and a vertical direction represents a gate signal transmitted to each pixel line. Reference characters OE1, OE2 or OE3 written under each of the gate signals Gout1 through Gout7 indicate a corresponding first through third output enable signal OE1 through OE3, respectively, transmitted to each pixel line.

Figure 10B:
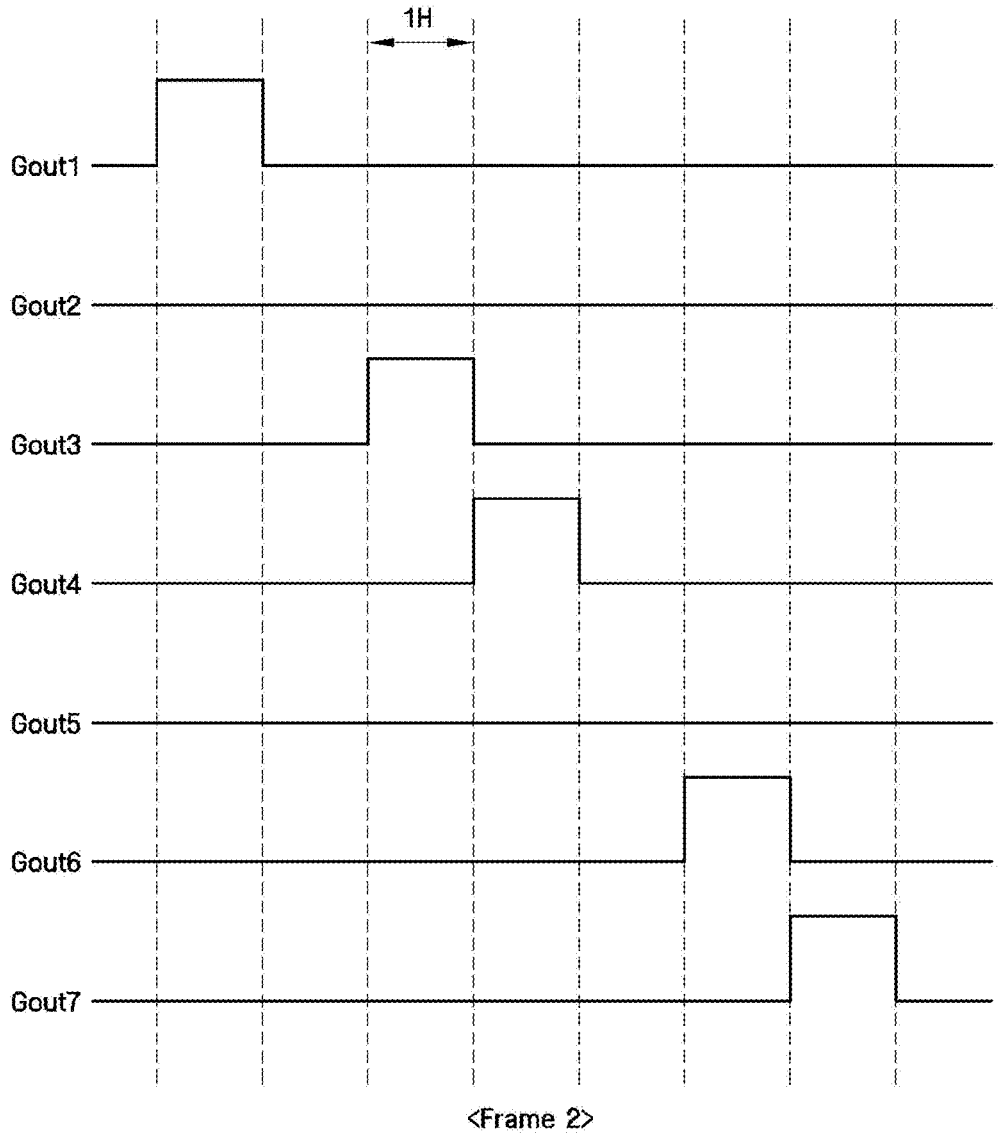
Figure 10C:
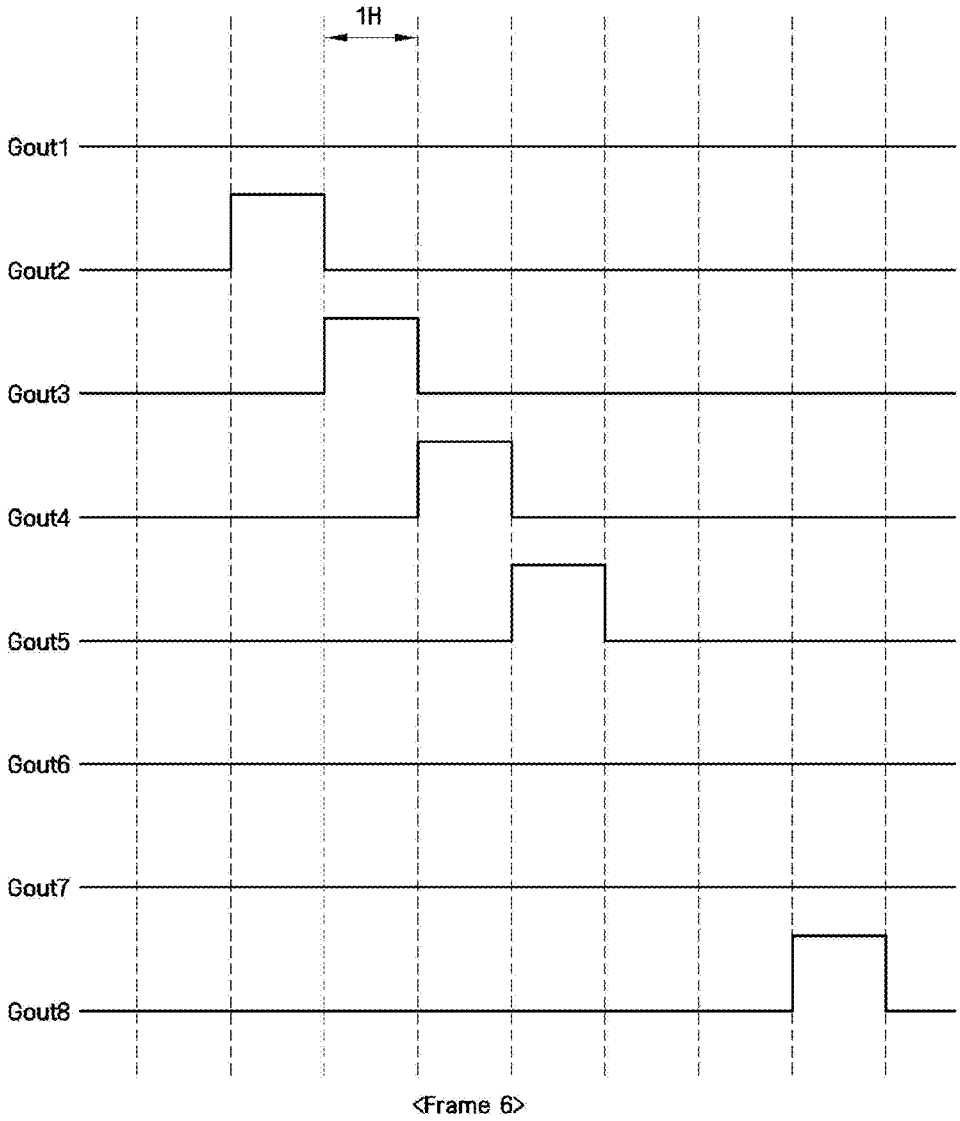
Figure 10D:
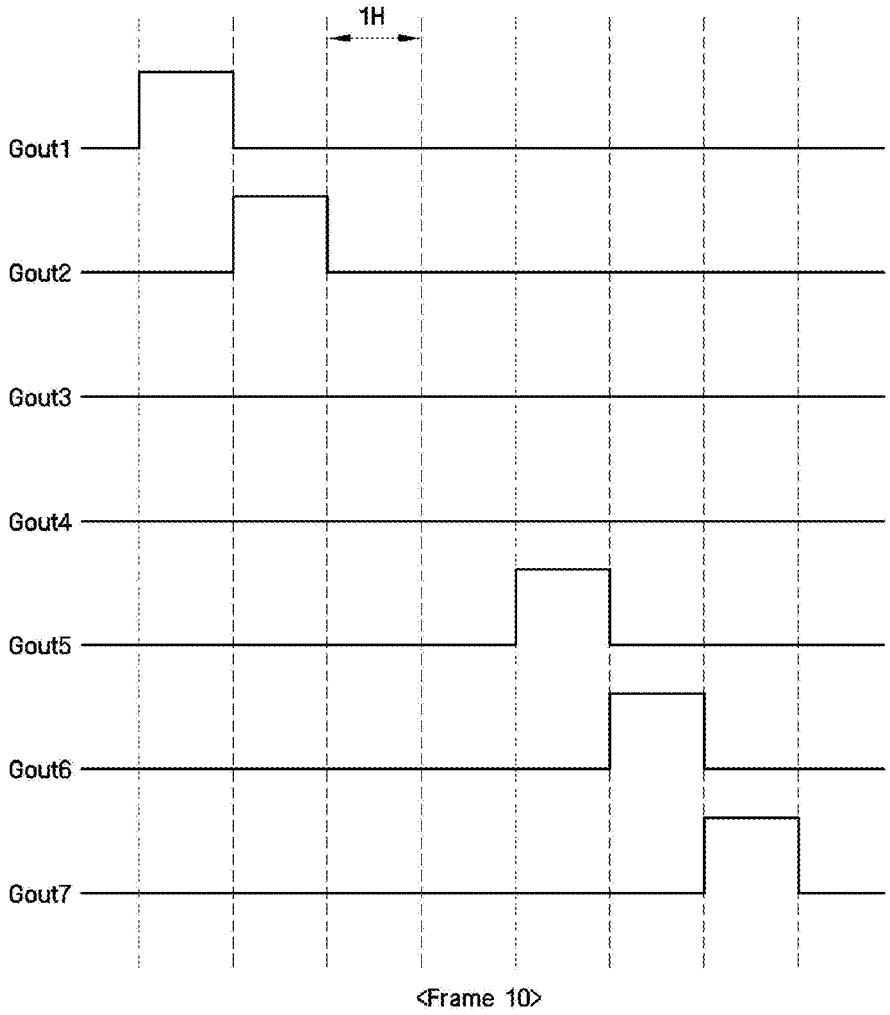

FIG. 10B illustrates gate signals which are or, alternatively, are not outputted in a second frame. As described above, gate signals (e.g., the second and fifth gate signals Gout2 and Gout5) are not outputted to second and fifth pixel lines, to which the first output enable signal OE1 is transmitted, and data voltages applied to the second and fifth pixel lines in a preceding frame (e.g., the first frame) are maintained. Likewise, referring to FIGS. 10C and 10D, gate signals (e.g., the first and sixth gate signals Gout 1 and Gout 6) are outputted to first and sixth pixel lines in a sixth frame in response to the second output enable signal OE2, and gate signals (e.g., the third and fourth gate signals Gout3 and Gout4) are not outputted to third and fourth pixel lines in a tenth frame in response to the third output enable signal OE3. More particularly, the gate signal Gout7 is not outputted to a seventh pixel line because each line block LB includes only six pixel lines. Therefore, the seventh pixel line corresponds to a first pixel line of a next frame, e.g., a seventh frame, and operates in substantially the same way as the first pixel line of the sixth frame.

As a result, gate signals are not outputted to two or more pixel lines in a succeeding frame of two or more successive frames in each of the set frames SFa through SFf, and no data voltages are therefore applied to the two or more pixel lines. Accordingly, an actual frame rate of each of the set frames SFa through SFf is substantially reduced in the LCD 11 according to an exemplary embodiment.

More specifically, gate signals are outputted to all pixel lines in the first frame of the first set frame SFa. A first data transmission speed will hereinafter be referred to as a first frame rate. In the second frame of the first set frame SFa, gate signals are not outputted to two or more pixel lines in each line block LB, and no data voltages are applied to the two pixel lines, as described above. This second data transmission speed will hereinafter may be referred to as a second frame rate. Therefore, the data driver 700 according to an exemplary embodiment operates at the first frame rate or at the second frame rate, which is lower than the first frame rate. Moreover, in a succeeding frame of two or more successive frames in which the polarities of two or more pixel lines remain unchanged over the two or more successive frames, the data driver 700 operates at the second frame rate. In the remaining frame or frames of the two or more successive frames, the data driver 700 operates at the first frame rate.

Thus, in the LCD 11 and the method of driving the same according to an exemplary embodiment, each of a plurality of output enable signals determines whether to output gate signals. Thus, power consumption of the LCD 11 is substantially reduced and/or is effectively minimized The present invention should not be construed as being limited to the exemplary embodiments set forth herein. Rather, these exemplary embodiments are provided so that this disclosure will be thorough and complete and will fully convey the concept of the present invention to those skilled in the art While the present invention has been particularly shown and described with reference to exemplary embodiments thereof, the exemplary embodiments should be considered in a descriptive sense only and not for purposes of limitation, and it will be understood by those of ordinary skill in the art that various changes in form and detail may be made therein without departing from the spirit or scope of the present invention as defined by the following claims.

What is claimed is:

1. A liquid crystal display comprising:

a liquid crystal panel comprising gate lines, data lines crossing the gate lines and pixels connected to the gate lines and the data lines, the pixels being grouped into pixel lines; and a data driver which performs line-inversion driving by applying a data voltage having one of a positive polarity and a negative polarity to the pixels such that the pixels in a given pixel line have a same polarity, wherein the pixel lines are divided into a first pixel line group and a second pixel line group, a polarity of the pixels in each pixel line in the first pixel line group is the same as a polarity of the pixels in one of both pixel lines disposed on two immediately adjacent sides thereof, a polarity of the pixels in each pixel line of the second pixel line group is opposite to a polarity of the pixels in both pixel lines disposed on two immediately adjacent sides thereof, and a plurality of the first pixel line groups and a plurality of the second pixel line groups, wherein the pixel lines are further divided into an uninterrupted sequence of line blocks which comprise at least one of the first pixel line groups and at least one of the second pixel line groups, and wherein a total number of the pixel lines in each of the line blocks is equal to a, a total number of the pixel lines in each of the second pixel line groups in each of the line blocks is equal to b, and a ratio a:b is 3:1.

2. The liquid crystal display of claim 1, wherein each of the line blocks comprises first through sixth pixel lines, a data voltage having the positive polarity is applied to the first, second and fourth pixel lines in a given frame, and a data voltage having the negative polarity is applied to the third, fifth and sixth pixel lines in the given frame.

3. The liquid crystal display of claim 1, wherein each of the line blocks comprises first through sixth pixel lines, a data voltage having the negative polarity is applied to the first, second and fourth pixel lines in a given frame, and a data voltage having the positive polarity is applied to the third, fifth and sixth pixel lines in the given frame.

4. The liquid crystal display of claim 1, wherein polarities of two or more of the pixel lines of the line blocks are constant for two or more successive frames.

5. The liquid crystal display of claim 4, further comprising:

a gate driver connected to the gate lines and which provides a gate signal to the gate lines;

a storage driver connected to the gate lines and which applies a boost voltage to the pixels in response to a boost control signal corresponding to the gate signal; and storage lines connected to the storage driver and which supply the boost voltage to the pixels.

6. The liquid crystal display of claim 5, wherein the pixels comprise:

a liquid crystal capacitor which is charged with the data voltage in response to the gate signal; and a storage capacitor connected to the liquid crystal capacitor, wherein the boost voltage is applied to the storage capacitor in response to the boost control signal.

7. The liquid crystal display of claim 5, further comprising a clock generator which generates output enable signals to control an output of the gate signals from the gate driver such that two or more selected pixel lines in two or more successive frames are selected in response to the output enable signals, and polarities of the two or more selected pixel lines are constant for the two or more successive frames.

8. The liquid crystal display of claim 7, wherein the output enable signals comprise first through third output enable signals, and the gate signals are not output to the two or more selected pixel lines in response to at least one of the first through third output enable signals.

9. The liquid crystal display of claim 1, wherein the data driver repeats the line-inversion driving in units of twelve frames.

10. A method of driving a liquid crystal display, the method comprising: providing a liquid crystal panel, the liquid crystal panel comprising:

gate lines;

data lines crossing the gate lines; and pixels connected to the gate lines and the data lines, wherein the pixels are grouped into a pixel lines; and performing line-inversion driving by applying a data voltage having one of a positive polarity and a negative polarity to the pixels, such that the pixels in each pixel line have a same polarity, wherein the pixel lines are divided into a first pixel line group and a second pixel line group, a polarity of the pixels in each pixel line of the first pixel line group is the same as a polarity of the pixels in one of both pixel lines disposed on two immediately adjacent sides thereof, a polarity of the pixels in each pixel line of the second pixel line group is opposite to a polarity of the pixels in both pixel lines disposed on two immediately adjacent sides thereof, and a plurality of the first pixel line groups and a plurality of the second pixel line groups, wherein the pixel lines are further divided into an uninterrupted sequence of line blocks which comprise at least one of the first pixel line groups and at least one of the second pixel line groups, and wherein a total number of the pixel lines in each of the line blocks is equal to a, a total number of the pixel lines in each of the second pixel line groups in each of the line blocks is equal to b, and a ratio a:b is 3:1.

11. The method of claim 10, further comprising:

a data voltage having the positive polarity is applied to the first, second and fourth pixel lines in a given frame, and a data voltage having the negative polarity is applied to the third, fifth and sixth pixel lines in the given frame, wherein each of the line blocks comprises first through sixth pixel lines.

12. The method of claim 11, wherein polarities of two or more pixel lines of the line blocks are constant for two or more successive frames.

13. The method of claim 12, wherein each of the pixels comprises:

a liquid crystal capacitor which is charged with the data voltage in response to a gate signal; and a storage capacitor connected to the liquid crystal capacitor, wherein a boost voltage is applied to the storage capacitor in response to the gate signal.

14. The method of claim 13, further comprising providing output enable signals which determine whether to output the gate signals, wherein each of the output enable signals selects the two or more pixel lines having polarities which are constant for the two or more successive frames.

15. The method of claim 14, wherein the output enable signals comprise first through third output enable signals, and the gate signals are not output to the two or more pixel lines in response to at least one of the first through third output enable signals.

16. The method of claim 11, wherein the performing the line-inversion driving is repeated in units of twelve frames.

17. A liquid crystal display comprising:

a liquid crystal panel comprising gate lines, data lines crossing the gate lines and pixels connected to the gate lines and the data lines, the pixels being grouped into pixel lines; and a data driver which performs line-inversion driving by applying a data voltage having one of a positive polarity and a negative polarity to the pixels such that the pixels in a given pixel line have a same polarity, wherein the pixel lines are divided into a first pixel line group and a second pixel line group, a polarity of the pixels in each pixel line in the first pixel line group is the same as a polarity of the pixels in one of both pixel lines disposed on two immediately adjacent sides thereof, a polarity of the pixels in each pixel line of the second pixel line group is opposite to a polarity of the pixels in both pixel lines disposed on two immediately adjacent sides thereof, and a plurality of the first pixel line groups and a plurality of the second pixel line groups, wherein the pixel lines are further divided into an uninterrupted sequence of line blocks which comprise at least one of the first pixel line groups and at least one of the second pixel line groups, and wherein a total number of the pixel lines in each of the line blocks is equal to a, a total number of the pixel lines in each of the second pixel line groups in each of the line blocks is equal to b, and a ratio a:b is 3:1, wherein a is equal to 6.

* * * * *